US007140829B2

(12) United States Patent
Neunteufel et al.

(10) Patent No.: US 7,140,829 B2
(45) Date of Patent: Nov. 28, 2006

(54) DEVICE FOR DISPLACING A REVOLVING STRUCTURE ON A CHASSIS AND VEHICLE, E.G. A DIGGER, HAVING SAID REVOLVING STRUCTURE DISPLACEMENT

(76) Inventors: Hans Neunteufel, Auf Der Gugl 48, Linz (AT) 4020; Josef Erlinger, 92 Herzogsdorf, Herzogsdorf (AT) 4175

( * ) Notice: Subject to any disclaimer, the term of this patent is extended or adjusted under 35 U.S.C. 154(b) by 213 days.

(21) Appl. No.: 10/484,732

(22) PCT Filed: Jul. 17, 2002

(86) PCT No.: PCT/EP02/07966

§ 371 (c)(1),
(2), (4) Date: Jan. 20, 2004

(87) PCT Pub. No.: WO03/012215

PCT Pub. Date: Feb. 13, 2003

(65) Prior Publication Data

US 2004/0217628 A1 Nov. 4, 2004

(30) Foreign Application Priority Data

Jul. 20, 2001 (EP) ..... 01116779

(51) Int. Cl.
*E02F 5/02* (2006.01)

(52) U.S. Cl. ..... 414/695.8; 414/687; 414/694; 414/695.7

(58) Field of Classification Search ..... 414/687, 414/694, 685, 695, 695.8, 695.7; 212/245
See application file for complete search history.

(56) References Cited

U.S. PATENT DOCUMENTS 287,631 A 10/1883 Cook
3,664,528 A 5/1972 Gauchet (Continued)

FOREIGN PATENT DOCUMENTS

EP 0 187 944 7/1986

(Continued)

*Primary Examiner*—J. Allen Shriver
*Assistant Examiner*—Cynthia F. Collado
(74) *Attorney, Agent, or Firm*—Jordan and Hamburg LLP

(57) ABSTRACT

The operating pressure for the hydraulic drive means (15; 26) is generated in the chassis (2) of the vehicle (1). A revolving structure (3) is arranged on the chassis, said revolving structure carrying the driver's cabin (7), a boom (5) with a tools (6) and a hydraulic motor for rotation of the revolving structure (3) relative to the chassis. The revolving structure is connected to the chassis by a live ring (16;23) that is driven by said hydraulic motor and has a hydraulic fluid duct (12;24) between the chassis and the revolving structure. The chassis is provided with an eccentric plate (11) carrying on its top side the above-mentioned live ring for the revolving structure while the bottom side of said eccentric plate has an eccentrically supported displacement bearing (13). Said displacement bearing is secured by a latching device (25) on the bottom side of the eccentric plate (11) during normal operation of the vehicle or digger (1). In order to displace the revolving structure (3) relative to the chassis (2), the displacement bearing (13) is unlatched and the revolving structure is fixed to the ground with the aid of the boom (5). Displacement of the revolving structure is carried out by actuating the hydraulic motor when the displacement bearing is unlatched. A linearly guided displacement plate (21) for lateral displacement can also be used instead of the eccentric plate.

23 Claims, 7 Drawing Sheets

U.S. PATENT DOCUMENTS

| | | | | |
|---|---|---|---|---|
| 4,433,495 | A | 2/1984 | Kishi | |
| 4,661,040 | A | 4/1987 | Cigna | |
| 4,693,662 | A * | 9/1987 | Haringer | 414/695 |
| 4,746,264 | A * | 5/1988 | Kishi et al. | 414/687 |
| 5,135,348 | A * | 8/1992 | Kishi et al. | 414/695.8 |
| 6,250,423 | B1 | 6/2001 | Bartsch | |

FOREIGN PATENT DOCUMENTS

| | | |
|---|---|---|
| FR | 2 734 294 | 11/1996 |
| GB | 2 092 102 | 8/1982 |
| JP | 51 067602 | 6/1976 |
| JP | 59 170335 | 9/1984 |

* cited by examiner

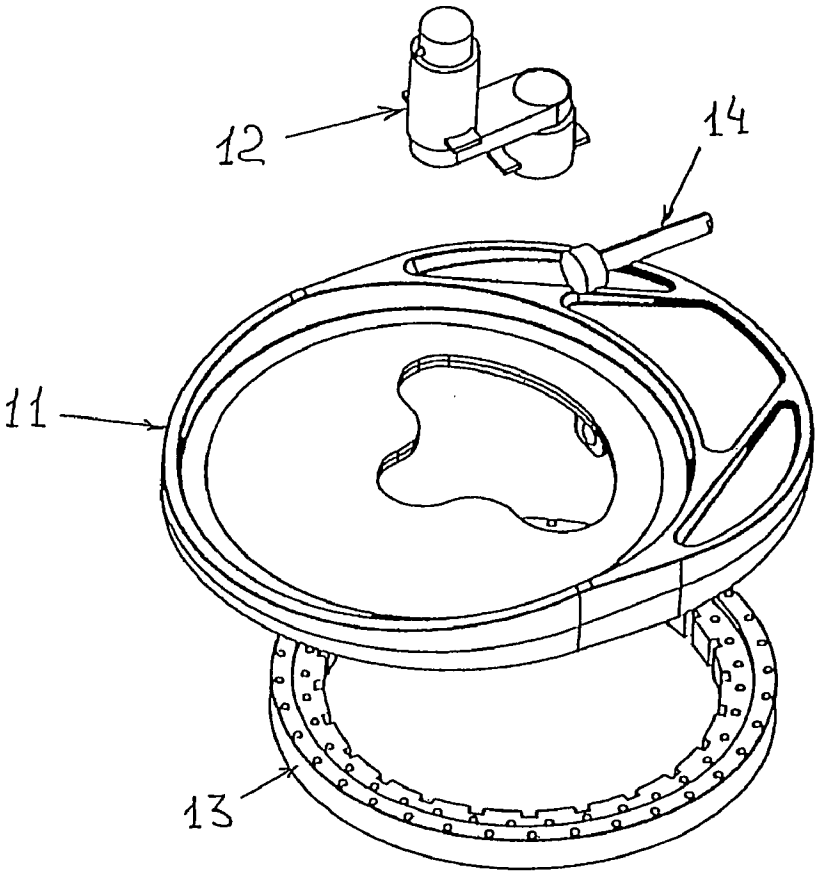
Fig. 4 B)
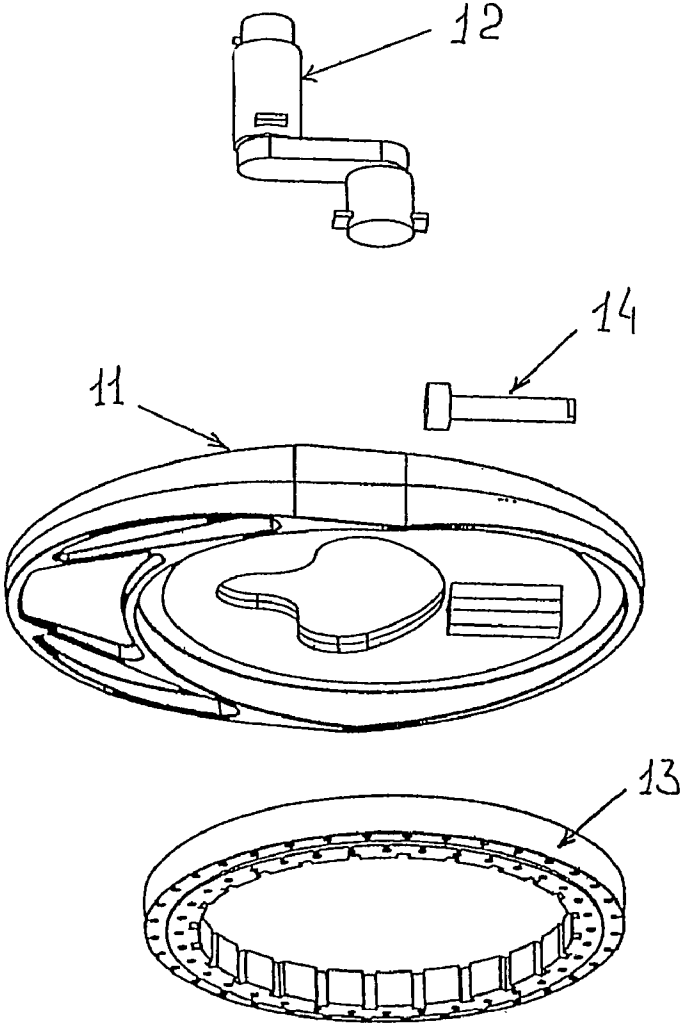

DEVICE FOR DISPLACING A REVOLVING STRUCTURE ON A CHASSIS AND VEHICLE, E.G. A DIGGER, HAVING SAID REVOLVING STRUCTURE DISPLACEMENT

The invention relates to vehicles, in particular excavators or loaders, that have a chassis and a rotatable superstructure thereupon. Such vehicles are known in general. The invention relates in particular to an apparatus for displacing the superstructure relative to the chassis and furthermore relates to a vehicle that is equipped with such a superstructure.

Known from prior art EP 187 944 is an earth-working machine with a mobile chassis. Rotatably affixed to the mobile chassis 10 is a turntable 14 with hydraulic drive means 18. Eccentric to the drive means 18, a rotatable carriage 20 with the mechanism for the earth-work is affixed on the turntable 14. The carriage 20 with the earth-working mechanism can rotate about an angular range of 360° independent of the turntable drive 14, 18.

Furthermore known from U.S. Pat. No. 4,693,662 is a compact excavator in which the superstructure is also rotatable relative to the chassis. In addition, the superstructure boom can be pivoted to the left or to the right using a guide. This design is intended to simplify additional movements required of the driver to operate the equipment.

Finally, known from prior art GB 2 092 102 is a rotating part 15 that is rotatably borne on the platform 11 of a chassis and bears a structure 17 that can rotate about a second axis of rotation. When the boom 19 of the structure 17 is caused to move away from the excavation site 18, the shovel of the boom 19 describes a path X that projects laterally in less than a circular shape.

Common to this prior art is that an additional rotating or pivoting motion on the superstructure is possible in addition to the conventional rotating movement of the superstructure relative to the chassis. However, the overall design that permits the additional motion is too complex in all known instances. Furthermore, in this prior art the ratio of dump load to the rear working range of the pivoting superstructure is not taken into account. In addition, the prior art suffers from the problem that in compact excavators, whose superstructures are designed with a limited working range, the driver's cab arranged on the superstructure is quite confined and the parts thereunder are very difficult to access for maintenance.

The object of the invention is therefore to suggest an apparatus for displacing the superstructure, which is rotatably arranged in a known manner relative to the chassis of a vehicle, said apparatus being embodied in such a simple manner that it can be retrofitted as a kit in a vehicle such as for instance an excavator or loader.

This object is inventively achieved by a displacement apparatus in accordance with claim 1. In accordance with claim 2, the displacement apparatus contains an eccentric plate for a circular displacement movement; a linearly-guided displacement plate is provided in accordance with the alternative in claim 3; claim 4 suggests combining the eccentric plate and the displacement plate to obtain a combination of the circular and linear displacement movement. Independent claim 15 provides a vehicle, in particular an excavator or loader, in which such a displacement apparatus is installed. Useful further developments of the invention are found in the dependent claims.

In the invention, the chassis is provided with an eccentric plate or displacement plate that bears the live ring for the superstructure and that also has a displacement bearing or linear guide. This eccentric plate with displacement bearing or this displacement plate with linear guide can be installed with nothing further, e.g. between the chassis and the superstructure of a conventional excavator or loader. The eccentric plate and the displacement plate can also be combined with one another in that the displacement bearing of the eccentric plate is mounted on the displacement plate.

In accordance with the invention, the displaceable superstructure furthermore has the advantage that it can use the displacement space available either for adjustably increasing the permissible dump load or alternatively for decreasing the rear working range of the superstructure when it pivots. The rear working range of the superstructure decreases (i.e., the ability to work in constrained physical spaces improves correspondingly) when the superstructure is displaced relative to its base in the direction of the boom. Conversely, the permissible dump load increases (i.e., the boom can receive a correspondingly larger working load) when the superstructure is displaced relative to its base in a direction opposing the direction of the boom.

These improved working abilities can be attained inventively without building the superstructure too compactly and this being unreasonably confining for the driver or operator in the cab. It is also substantially more maintenance-friendly when the superstructure is less compact than in the prior art.

The present invention is explained in greater detail in the following drawings. FIGS. 1 through 7 illustrate:

Figure 3:
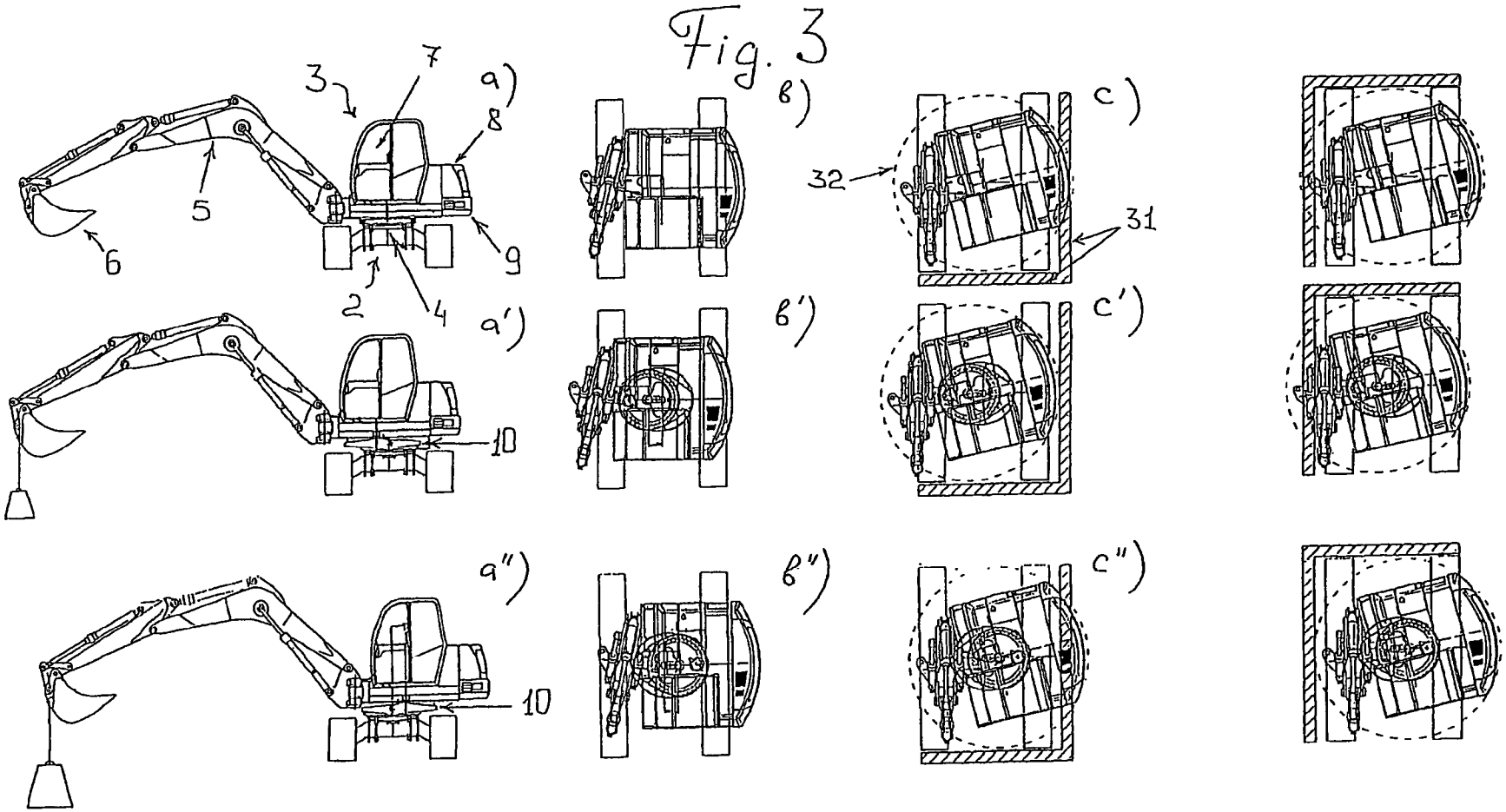
FIG. 3 is an excavator in which an inventive apparatus (in accordance with the third exemplary embodiment of the invention in accordance with FIG. 7) is installed, in three displacement phases.
Figure 5:
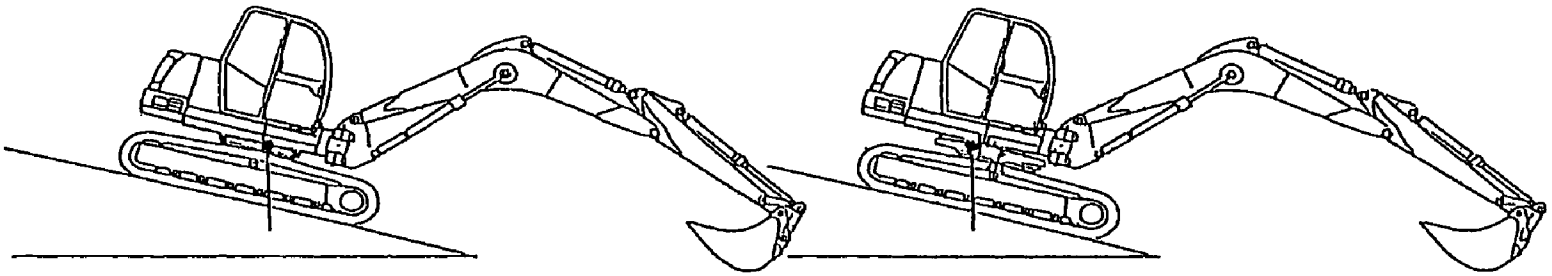
Figure 6:
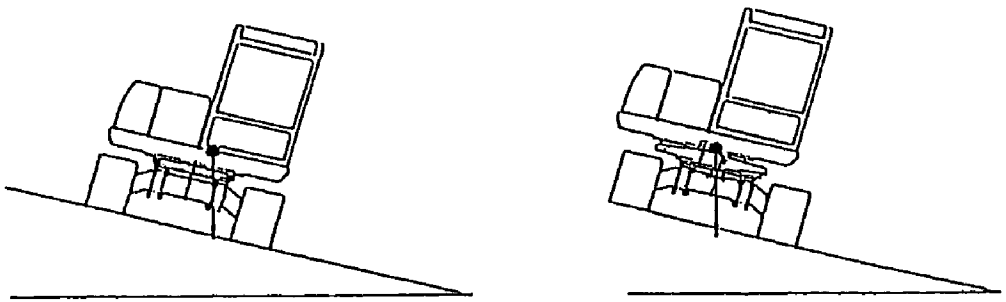
Figure 7:
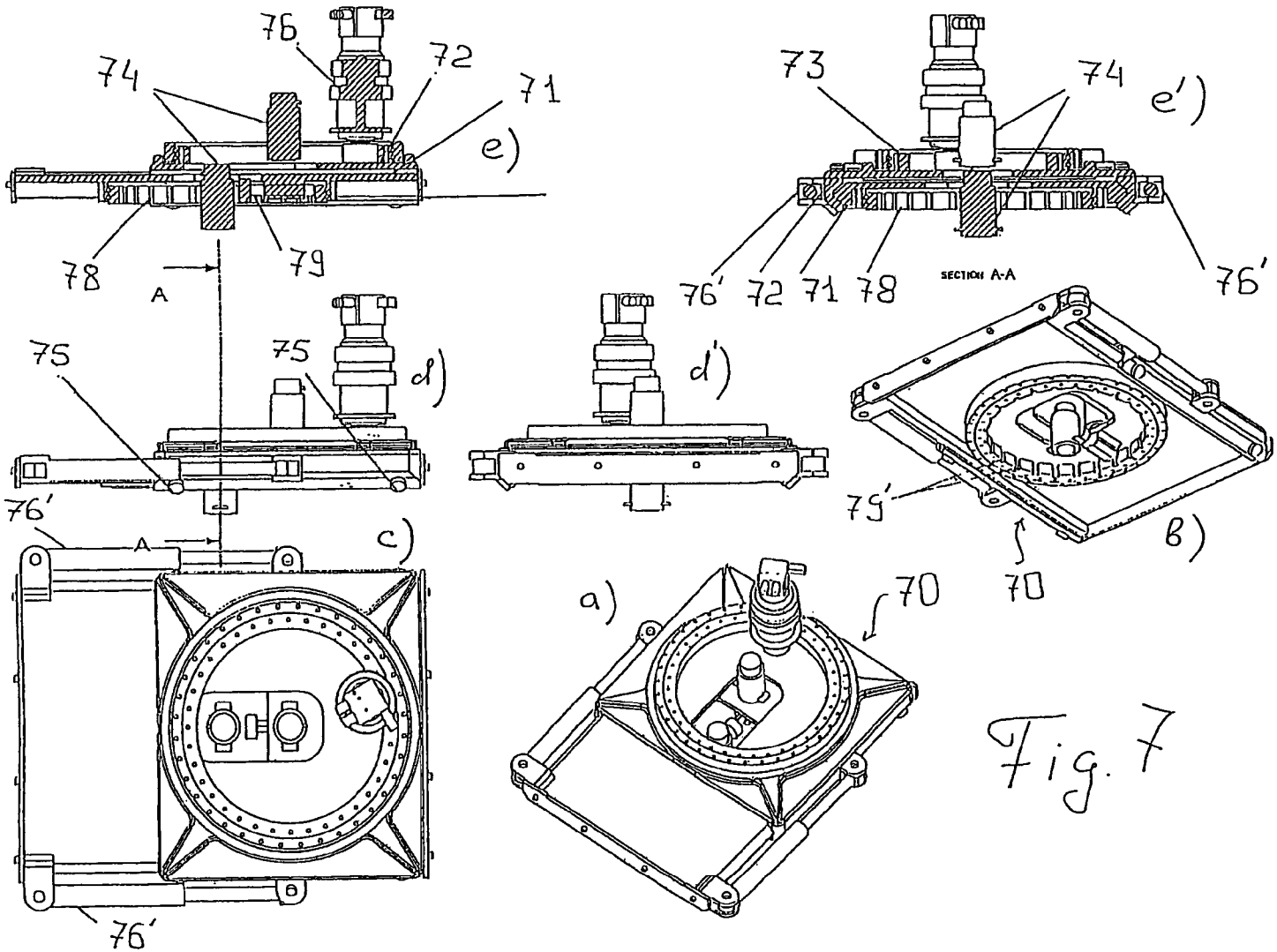

a) with the rotary drive and live ring associated with the superstructure,
b) solely as a kit;

FIG. 5 is an advantageous application of the inventive displacement apparatus in a longitudinal center-of-mass displacement;

FIG. 6 is an advantageous application of the inventive displacement apparatus in a lateral center-of-mass displacement, and FIG. 7 is a third exemplary embodiment of the inventive displacement apparatus a) in a perspective view from diagonally above,
b) in a perspective view from diagonally below,
c) in a view from above
d) and d') in two perspective views, and
e and e') in two sectional views The inventive displacement apparatus 10 is employed in a vehicle, illustrated in any of FIGS. 3*a*, 3*a*', and 3*a*", an excavator in this instance. The displacement apparatus 10 ensures a rotating and/or sliding displaceable connection between a chassis 2, provided with tires or chains and with hydraulic drive means 4, and a superstructure 3 of the excavator 1, provided with a boom 5, including tool, for instance an excavating shovel 6, a driver's cab 7, and a rear part 8. The connection between the chassis 2 and the superstructure 3 using the inventive displacement apparatus 10 has a number of significant advantages for the work capacity of the vehicle, that is, the excavator 1 or loader. Some of these advantages can be explained using the example in FIGS. 3*b*' and 3*c*' through 3*b*" and 3*c*" and using FIGS. 5 and 6.

For instance, the excavator 1 with the inventive displacement apparatus 10 can be used at sites that are constrained by obstacles or walls 31 that will not permit the use of conventional excavators. Depending on the relative positioning of the excavator 1 to the walls 31, the displacement apparatus 10 can be used to move the superstructure 3 relative to the chassis 2 resting on the ground such that a rear pivot circle 32 described by the rear part 8 of the superstructure 3 does not intersect the obstacles or walls 31. This is attained using the displacement apparatus 10, which is illustrated in greater detail in FIGS. 1, 2, 4, and 7.

Installation of the inventive displacement apparatus 10 in the vehicle, especially in the excavator 1 or loader, furthermore also ensures its advantageous employment on an inclined surface, as is illustrated in FIGS. 5 and 6. Advantageous employment of the excavator 1 results in both cases from a center-of-mass displacement for the entire vehicle that is advantageous on the inclined surface. Thus, for instance, the longitudinal displacement of the superstructure 3 relative to the chassis 2, as illustrated in FIG. 5, leads to more uniform distribution of weight between the chassis 2 and the surface. This in turn results in increased traction and thus better hill climbing ability for the vehicle or excavator 1 on steep terrain. In addition, lateral displacement of the superstructure 3 relative to the chassis 2, as is illustrated in FIG. 6, has the advantage that a center-of-gravity displacement of the entire vehicle effected by displacement can substantially reduce the danger of the vehicle tipping over laterally on inclined terrain. The option described above for displacing the center of gravity of the entire vehicle also leads to the fact that the vehicle can work with higher loads when the center of gravity of the vehicle is advantageously displaced using the displacement apparatus 10 commensurate with the surface's incline.

FIGS. 1*a* through 1*e* illustrate various views of the inventive displacement apparatus 10 in accordance with a first exemplary embodiment. The displacement apparatus 10 has an eccentric plate 11 and an eccentric rotary duct 12. The eccentric plate 11 can be reinforced with ribs 17.

An apparatus for receiving a bearing-type live ring 16 is provided on the top side of the eccentric plate 11. The displacement apparatus 10 furthermore has a rotary drive 15 that drives the live ring 16. The live ring 16 is connected to the superstructure 3 when the excavator 1 is assembled. The superstructure 3 can thus rotate about a live ring center axis 18 relative to the eccentric plate 11 using the rotary drive 15.

An apparatus for receiving a displacement bearing 13 is provided on the bottom side of the eccentric plate 11. When the vehicle 1 is assembled or when the displacement apparatus 10 is installed in a series excavator 1, the displacement bearing 13 is connected to the chassis 2 of the vehicle 1 such that the eccentric plate 11 is rotatable about a displacement bearing center axis 19 relative to the chassis 2 of the vehicle 1.

Figure 1:
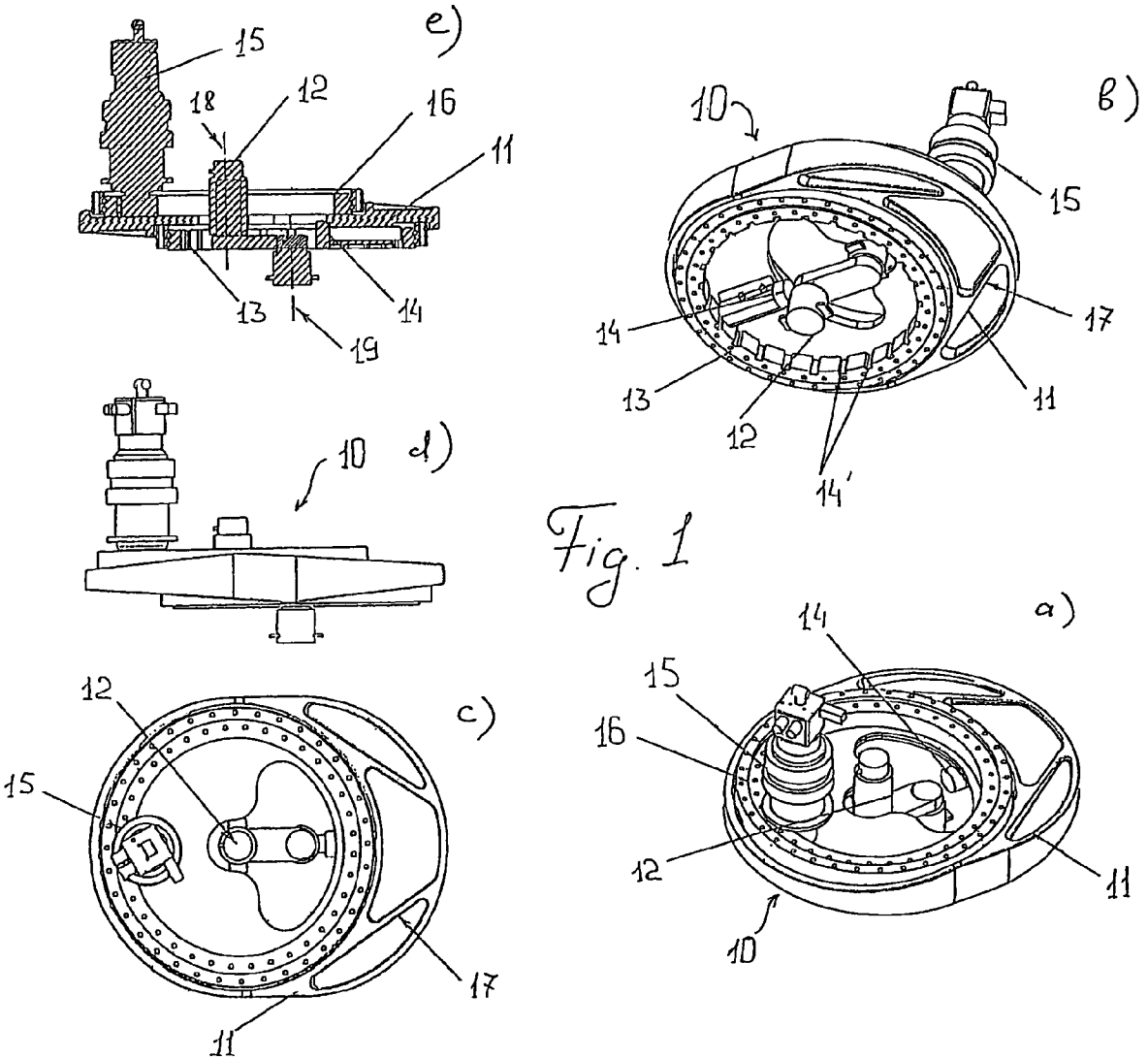
FIG. 1 is a first exemplary embodiment of the inventive displacement apparatus a) in a view from diagonally above,
b) in a view from diagonally below,
c) in a view from above
d) in a perspective view, and,
e) in a sectional view.

Since the live ring center axis 18 and the displacement bearing center axis 19 are arranged eccentrically to one another, the advantageous displacement movement of the superstructure 3 relative to the chassis 2 mentioned in the foregoing is ensured. In order to ensure the displacement of the eccentric plate 11 relative to the chassis 2, a locking apparatus 14 is provided on the bottom side of the eccentric plate 11. The locking apparatus can be embodied as depicted in FIG. 1. The locking apparatus has a lock 14 that can engage in slots 14' provided on the interior of the displacement bearing 13 and that can thus prevent relative displacement of the eccentric plate 11 and the displacement bearing 13.

Figure 2:
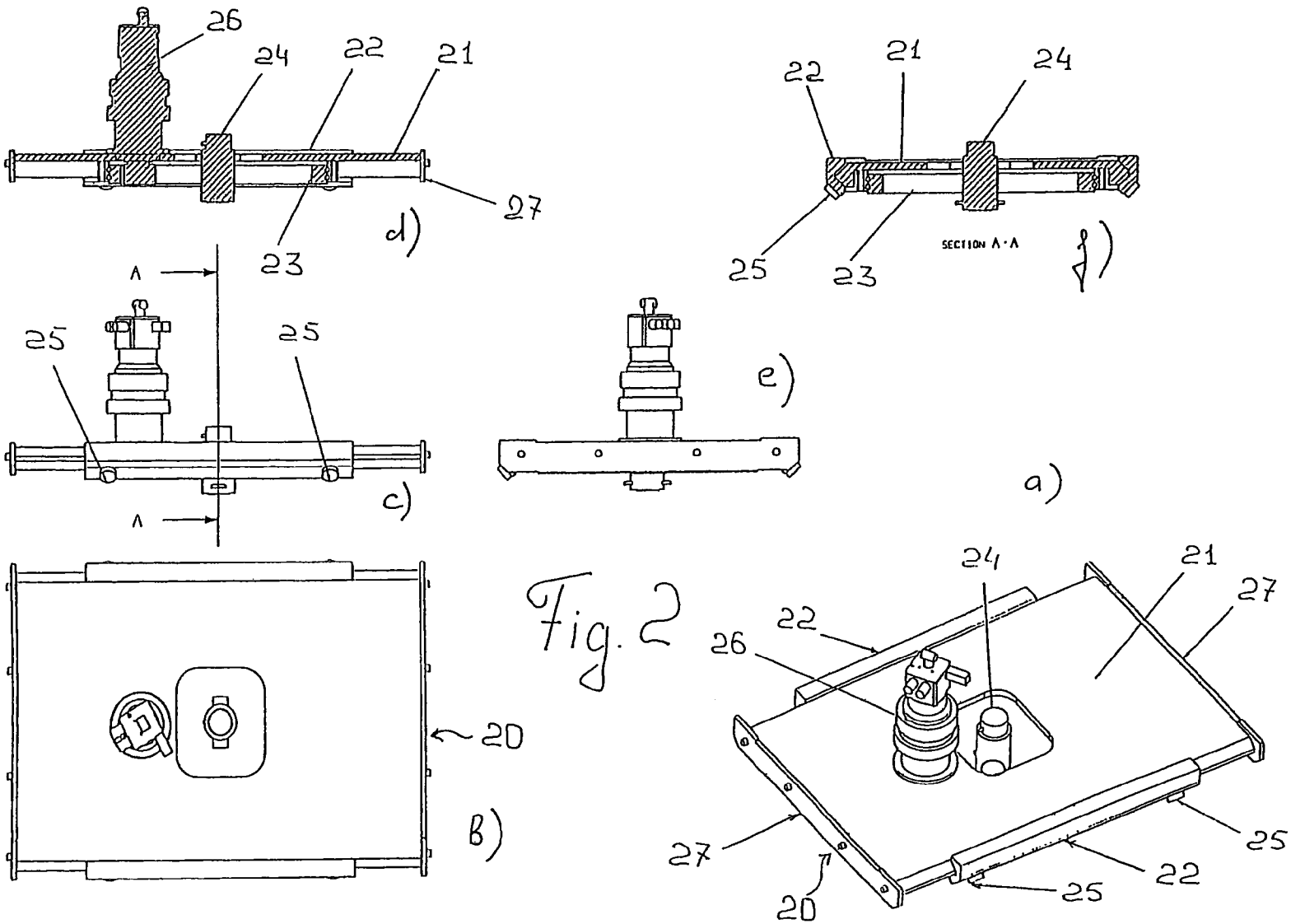
FIG. 2 is a second exemplary embodiment of the inventive displacement apparatus a) in a view from diagonally above,
b) in view from above,
c) in a perspective view,
d) in a sectional view,
e) in a side view, and,
f) in a sectional side view.

FIG. 2 illustrates an alternative exemplary embodiment of the inventive superstructure displacement apparatus 20. In this instance, the displacement does not occur by means of an eccentrically-disposed displacement bearing with a center axis 19, but rather by means of a displacement plate 21 that is guided linearly on the chassis 2. The displacement plate 21 is displaceably borne in opposing guides 22. Stops 27 limit this displacement movement.

In normal excavator operations, the displacement plate is secured by a lock 25. For displacing the superstructure 3, the lock 25 is released, the boom 5 is lowered for fixing the superstructure 3 in the front direction of the excavator 1 onto the ground, and the rotary drive 26 is actuated such that the live ring 23 is displaced with the displacement plate 21 in the guides 22. After displacement, the displacement plate 21 is re-secured by means of the lock 25. The lock 25 can be effected by hydraulic cylinders that act on a tappet or by any other known mechanical locking mechanism. For instance, a disk brake can be employed in the first cited exemplary embodiment in accordance with FIG. 1.

In the exemplary embodiment in accordance with FIG. 2, a standard rotary duct 24 is adequate for allowing the hydraulic fluid to flow between the generator of the operating pressure in the superstructure 3 and the hydraulic units in the chassis 2 (hydraulic engine, pressure cylinder, etc.).

FIG. 7 illustrates a third exemplary embodiment of the inventive displacement apparatus 70. The displacement apparatus 70 has the advantages of a combination of the displacement apparatus in accordance with the first exemplary embodiment and the displacement apparatus in accordance with the second exemplary embodiments. The displacement plate 71 of the displacement apparatus 70 is arranged in guides 72 of a center plate 71' and can be guided linear to the center plate 71' in said guides 72 using control cylinders 76'. A stop 77 is provided on the center plate 71' for limiting the aforesaid displacement movement of the displacement plate 71. The center plate 71' is connected to the chassis 2 of the excavator using a displacement bearing 78, whereby the center plate 71' is rotatable about the center axis of the displacement bearing 78. A lock 79 for the displacement bearing 78 is provided on the bottom side of the center plate 71'. The displacement bearing lock 79 can engage slots 79' situated on the interior of the displacement bearing 78, and can thus prevent the rotary movement of the center plate 71' relative to the displacement bearing 78 connected to the chassis 2. The described locking apparatus for locking the displacement bearing 78 can also be any locking device suitable for the purposes of this invention. The displacement plate 71 is connected to the superstructure 3 of the excavator 1 using a live ring 73, whereby the live ring 73 is rotatable about its center axis on the displacement plate 71. The rotary movement of the live ring 73 and the superstructure 3 of the excavator 1 connected thereto is ensured using a rotary drive 76. Likewise, as in the foregoing exemplary embodiments, the displacement apparatus 70 has a rotary duct 74 in order to permit the hydraulic fluid to flow between the generator of the operating pressure in the superstructure 3 of the excavator 1 and the hydraulic units (for instance, hydraulic engine, pressure cylinder, etc.) in the chassis 2 of the excavator 1.

Figure 4A:
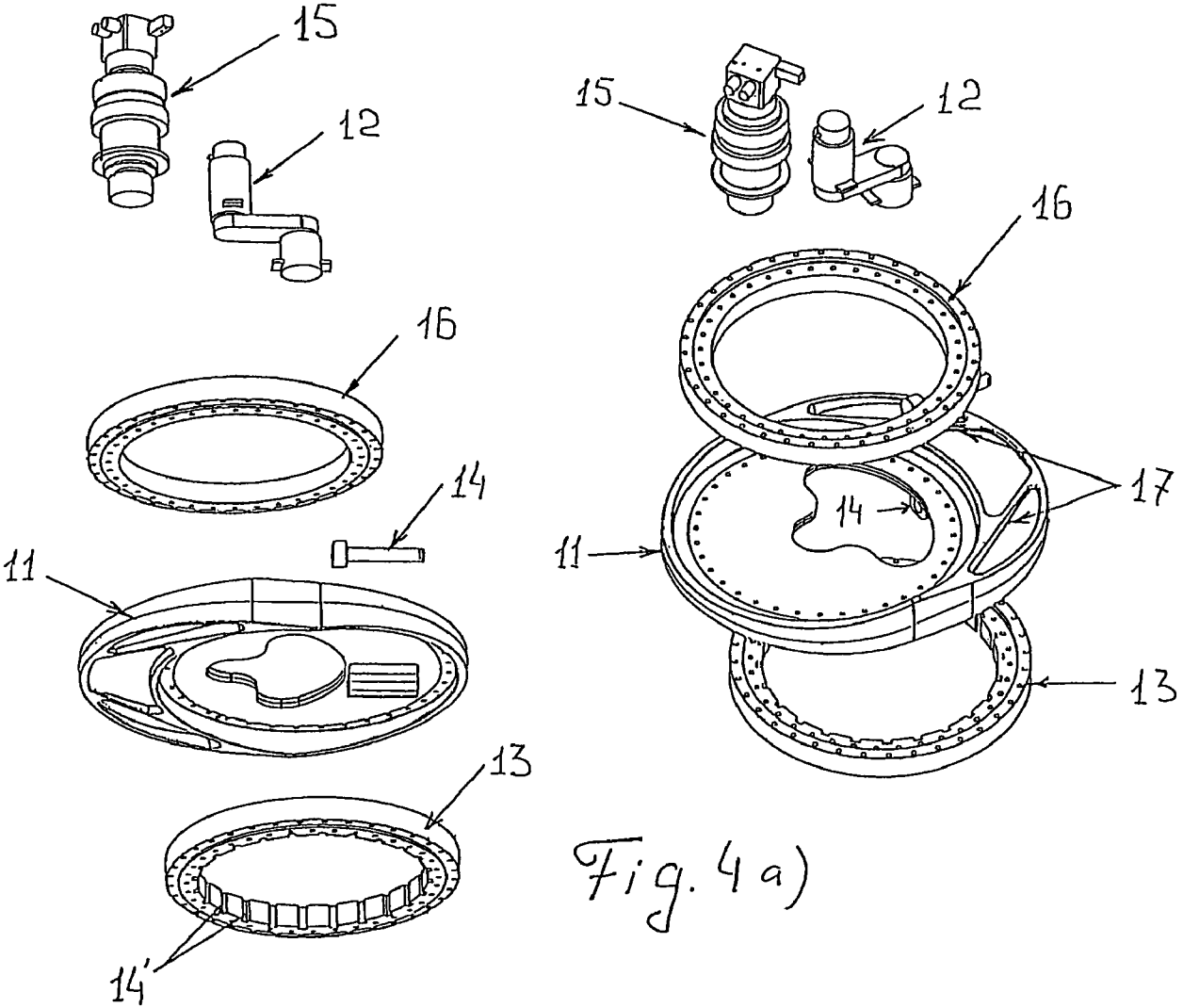
FIG. 4 is an inventive apparatus as kit (first exemplary embodiment in accordance with FIG. 1 in perspective views from diagonally above and from diagonally below.

In the exemplary embodiment in accordance with FIG. 1, the components 11 through 14 can be used as a kit that is retrofitted in a conventional excavator with live ring 15 and rotary drive 16. The kit with the eccentric plate, eccentric rotary duct, displacement bearing, and lock between eccentric plate and displacement bearing is illustrated in FIGS. 4*a* and 4*b* in an exploded drawing. The rotary drive 15 and the live ring 16 in accordance with FIG. 4*a* do not belong to the kit, but rather together with the superstructure 3 are released from the chassis 2 during installation.

Likewise, the displacement plate 21 from the second exemplary embodiment in accordance with FIG. 2 can be supplied as a kit and employed in a conventional excavator with live ring and rotary drive. For this, it is only necessary to lift the superstructure 3 from the chassis 2, mount the rotary drive and live ring on the displacement plate, and affix the guides 22 to the chassis 2. In this case the rotary duct already present on the live ring is adequate for the pressure means hoses; a separate eccentric rotary duct is not necessary in this instance.

The components of the displacement apparatus 70 can also be used without the live ring 73 and the rotary drive 76 in the exemplary embodiment in accordance with FIG. 7 as a kit that is retrofitted in a conventional excavator or loader with the live ring 73 and rotary drive 76. Likewise, as in the aforesaid instance, the rotary drive 76 and the live ring 73, together with the superstructure 3, can be released from the chassis 2 and installed at the site between the chassis 2 and the superstructure 3 with the live ring 73 and the rotary drive 76 of the aforesaid kit.

In contrast to the displacement apparatus in accordance with FIGS. 1 and 2, the displacement apparatus in accordance with FIG. 7 ensures a higher degree of freedom for displacing the superstructure 3 relative to the chassis 2 of the vehicle. Thus, the displacement apparatus in accordance with FIG. 7 ensures that the center axis of the live ring is not only displaceable along certain paths, but rather is freely displaceable in two dimensions relative to the chassis (within certain design limits).

LEGEND

1 Vehicle or excavator
2 Chassis
3 Superstructure
4 Hydraulic drive means
5 Boom
6 Tool
7 Driver's cab
8 Rear part
9 Counterweight
10 Displacement apparatus
11 Eccentric plate
12 Eccentric rotary duct
13 Displacement bearing
14 Lock
14' Slot
15 Rotary drive
16 Live ring
17 Ribs
18 Center axis of live ring
19 Center axis of displacement bearing
20 Displacement apparatus
21 Displacement plate
22 Guide
23 Live ring
24 Rotary duct
25 Lock
26 Rotary drive
27 Stop
31 Obstacles, e.g. walls
32 Rear pivot circle
70 Displacement apparatus
71 Displacement plate
71' Center plate
72 Guide
73 Live ring
74 Rotary duct
75 Lock for displacement plate
76 Rotary drive
76' Control cylinder
77 Stop
78 Displacement bearing
79 Lock for displacement bearing
79' Slot

The invention claimed is:

1. A vehicle comprising
a chassis,
hydraulic drive means in the chassis,
a superstructure on the chassis,
an apparatus for displacing the superstructure relative to the chassis so that said superstructure is eccentrically rotatable about said chassis,
said displacing apparatus directly connecting the superstructure to the chassis;
said superstructure including a cab for an operator of the vehicle, a boom, and a rotary drive for rotating the superstructure relative to the chassis,
means in the superstructure for generating hydraulic pressure for operating the rotary drive and the hydraulic drive means,
a live ring connecting the superstructure to the chassis, the live ring being engaged by the rotary drive and being driven thereby,
and wherein the apparatus for displacing the superstructure comprises
at least one of an eccentric plate and a displacement plate carrying the live ring,
a displacement bearing or a guide connecting the eccentric plate the displacement plate, respectively, to the chassis, and
a conduit for conducting hydraulic fluid between the superstructure and the chassis.

2. Vehicle according to claim 1, comprising the eccentric plate and wherein the live ring is situated on a top side of the eccentric plate.

3. Vehicle according to claim 1, comprising the displacement plate and wherein the live ring is situated under the displacement plate and the rotary drive engages the live ring by extending through the displacement plate.

4. A vehicle according to claim 1, comprising:
a center plate for forming a base part of said eccentric plate which connects the displacement bearing to the chassis,
and comprising the displacement plate for forming a top part of said eccentric plate;
the guide connecting the displacement plate to the center plate;

the live ring being disposed on a top side of the displacement plate; and a conduit for conducting hydraulic fluid between the superstructure and the chassis.

5. A vehicle according to claim 2, wherein the displacement bearing is situated on the underside of the eccentric plate, the displacement bearing and the live ring each have a respective center axis and the center axis of the displacement bearing is eccentric relative to the center axis of the live ring.

6. A vehicle according to claim 5, further comprising a lock for locking the displacement bearing when the superstrucure is not to be displaced relative to the chassis.

7. A vehicle according to claim 6, wherein for displacing the superstructure the lock is operable to unlock the displacement bearing and the boom is operable to fix the superstructure on a surface which is supporting the vehicle.

8. A vehicle according to claim 7, further comprising means for actuating the rotary drive thereby to displace the superstructure.

9. A vehicle according to claim 2, wherein the conduit comprises an eccentric rotary conduit in the eccentric plate.

10. A vehicle according to claim 3, comprising the displacement plate and wherein the guide is linear.

11. A vehicle according to claim 10, further comprising a lock for locking the displacement plate to the guide when the superstructure is not to be displaced relative to the chassis.

12. A vehicle according to claim 11, further comprising stops on the displacement plate for limiting the displacement.

13. A vehicle according to claim 12, further comprising means for unlocking the lock and means for actuating the rotary drive thereby to displace the superstructure after the lock has been unlocked.

14. A vehicle according to claim 2, wherein the conduit is a rotary conduit.

15. A vehicle according to claim 4, wherein the displacement bearing is situated on the underside of the eccentric plate, the displacement bearing and the live ring each have a respective center axis and the center axis of the displacement bearing is eccentric relative to the center axis of the live ring.

16. A vehicle according to claim 15, further comprising a lock for locking the displacement bearing when the superstructure is not to be displaced relative to the chassis.

17. A vehicle according to claim 16, wherein for displacing the superstructure the lock is operable to unlock the displacement bearing and the boom is operable to fix the superstructure on a surface which is supporting the vehicle.

18. A vehicle according to claim 17, further comprising means for actuating the rotary drive thereby to displace the superstructure.

19. A vehicle according to claim 4, wherein the conduit comprises an eccentric rotary conduit in the eccentric plate.

20. A vehicle according to claim 4, comprising the displacement plate and wherein the guide is linear.

21. A vehicle according to claim 20, further comprising a lock for locking the displacement plate to the guide when the superstructure is not to be displaced relative to the chassis.

22. A vehicle according to claim 20, further comprising stops on the displacement plate for limiting the displacement.

23. A vehicle comprising a chassis, hydraulic drive means in the chassis, a superstructure on the chassis, an apparatus for displacing the superstructure relative to the chassis, a cab for an operator of the vehicle, a boom, a rotary drive for rotating the superstructure relative to the chassis, the cab, the boom and the rotary drive being carried by the superstructure, means in the superstructure for generating hydraulic pressure for operating the rotary drive and the hydraulic drive means, a live ring connecting the superstructure to the chassis, the live ring being engaged by the rotary drive and being driven thereby, and wherein the apparatus for displacing the superstructure comprises an eccentric plate and a displacement plate carrying the live ring, a displacement bearing and a guide respectively connecting the eccentric plate and the displacement plate to the chassis, a center plate for forming a base part of said eccentric plate which connects the displacement bearing to the chassis, the displacement plate forming a top part of said eccentric plate wherein the guide connects the displacement plate to the center plate and wherein the live ring is situated on a top side of the displacement plate; and a conduit for conducting hydraulic fluid between the superstructure and the chassis.

* * * * *